US007566847B2

(12) United States Patent
McWilliams et al.

(10) Patent No.: US 7,566,847 B2
(45) Date of Patent: Jul. 28, 2009

(54) ELECTRICAL HEATING ASSEMBLY

(75) Inventors: Kevin Ronald McWilliams, Stratford on Avon (GB); Peter Ravenscroft Wilkins, Droitwich (GB)

(73) Assignee: Ceramaspeed Limited (GB)

( * ) Notice: Subject to any disclaimer, the term of this patent is extended or adjusted under 35 U.S.C. 154(b) by 427 days.

(21) Appl. No.: 11/365,542

(22) Filed: Mar. 1, 2006

(65) Prior Publication Data

US 2006/0196869 A1 Sep. 7, 2006

(30) Foreign Application Priority Data

Mar. 5, 2005 (GB) ..... 0504598.4

(51) Int. Cl.
*H05B 1/02* (2006.01)

(52) U.S. Cl. ..... 219/492; 219/412; 219/483; 219/448.1; 219/506; 99/325

(58) Field of Classification Search ..... 219/413–415, 219/483–486, 506, 497, 499, 446.1, 448.11, 219/448.18; 99/325–333
See application file for complete search history.

(56) References Cited

U.S. PATENT DOCUMENTS 4,414,465 A * 11/1983 Newton et al. ..... 219/448.14
5,397,873 A * 3/1995 Stoops et al. ..... 219/448.12
6,554,197 B2 * 4/2003 Marbach et al. ..... 236/20 A
6,940,048 B2 * 9/2005 Wilkins ..... 219/448.13

FOREIGN PATENT DOCUMENTS

DE 10064117 6/2002

OTHER PUBLICATIONS

International Search Report Dated Jun. 16, 2005.

* cited by examiner

*Primary Examiner*—Mark H Paschall
(74) *Attorney, Agent, or Firm*—Ira S. Dorman

(57) ABSTRACT

An electrical heating assembly (2) includes a control system (26). The control system (26) comprises cooking mode selection means (34) having a plurality of settings whereby a predetermined cooking mode is user-selectable for the electrical heating assembly (2), and cooking value selection means (36) adapted for user-selection of a cooking temperature within a predetermined temperature range. The control system (26) is adapted whereby operation of the cooking mode selection means (34) from one setting to at least one other setting results in a change in the predetermined temperature range provided by the cooking value selection means (36). In at least a first setting of the cooking mode selection means (34) only the first of first and second temperature-responsive devices (42, 30) is effective to control operation of a heater (12) and in at least a second setting of the cooking mode selection means (34) both the first and second temperature-responsive devices (42, 30) are effective to control operation of the heater.

25 Claims, 2 Drawing Sheets

Figure 1:
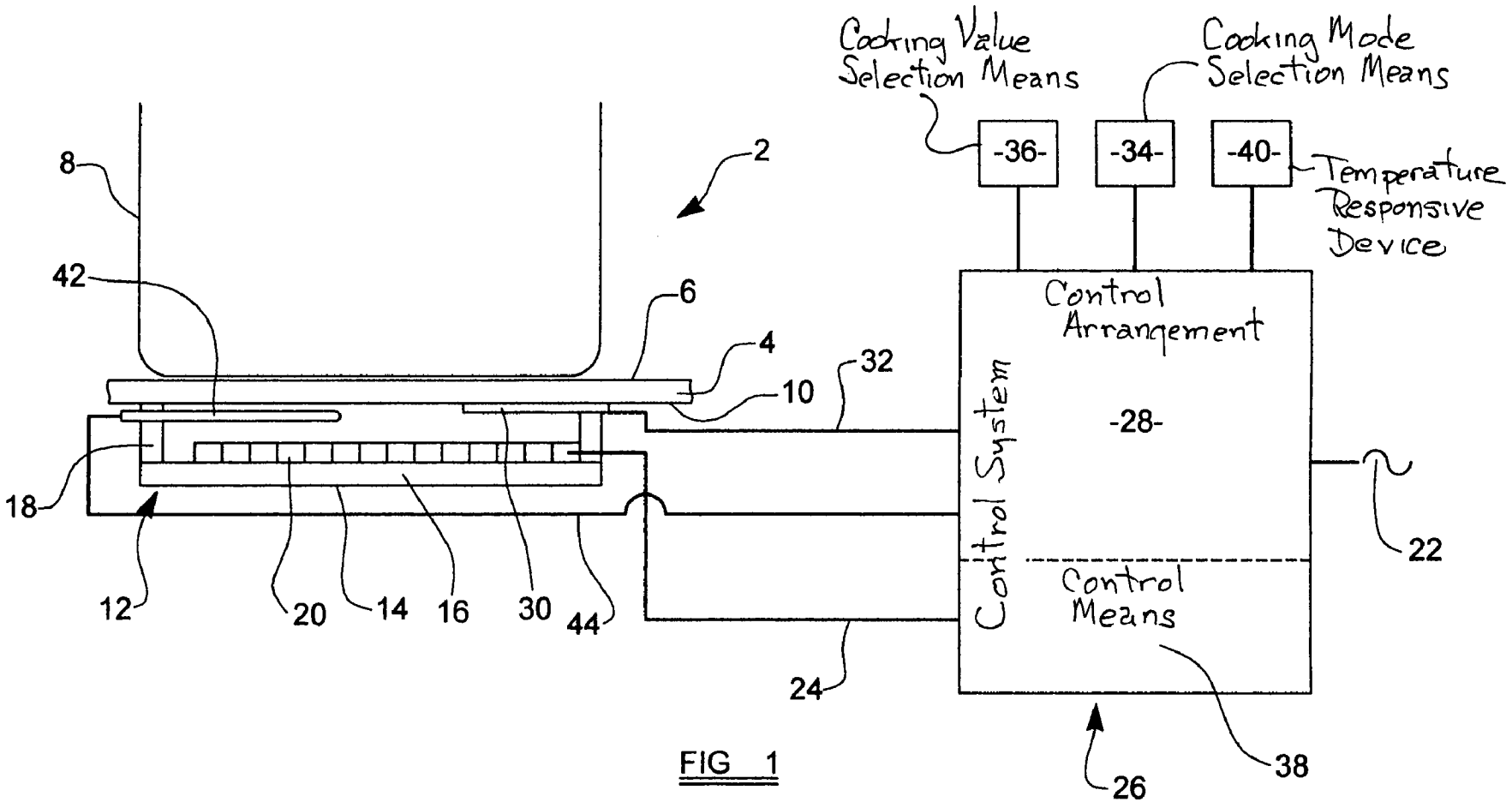

| NORMAL MODE | | SIMMER MODE | | FRYING MODE | |
|---|---|---|---|---|---|
| • Pre-set temperatures: | | • Pre-set temperatures: | | • Pre-set temperatures: | |
| Position | Temp °C | Position | Temp °C | Position | Temp °C |
| 9 | 600 | 9 | 100 | 9 | 300 |
| 8 | 475 | 8 | 95 | 8 | 280 |
| 7 | 375 | 7 | 90 | 7 | 260 |
| 6 | 275 | 6 | 85 | 6 | 240 |
| 5 | 200 | 5 | 80 | 5 | 220 |
| 4 | 150 | 4 | 75 | 4 | 200 |
| 3 | 125 | 3 | 70 | 3 | 180 |
| 2 | 100 | 2 | 65 | 2 | 160 |
| 1 | 60 | 1 | 60 | 1 | 140 |

FIG 2

| NORMAL MODE | | SIMMER MODE | | FRYING MODE | |
|---|---|---|---|---|---|
| • Pre-set power levels: | | • Pre-set temperatures: | | • Pre-set temperatures: | |
| Position | Duty cycle | Position | Temp °C | Position | Temp °C |
| 9 | 100% | 9 | 100 | 9 | 300 |
| 8 | 60% | 8 | 95 | 8 | 280 |
| 7 | 45% | 7 | 90 | 7 | 260 |
| 6 | 35% | 6 | 85 | 6 | 240 |
| 5 | 25% | 5 | 80 | 5 | 220 |
| 4 | 20% | 4 | 75 | 4 | 200 |
| 3 | 15% | 3 | 70 | 3 | 180 |
| 2 | 10% | 2 | 65 | 2 | 160 |
| 1 | 5% | 1 | 60 | 1 | 140 |

FIG 3

ELECTRICAL HEATING ASSEMBLY

This invention relates to an electrical heating assembly provided with a control system.

DESCRIPTION OF PRIOR ART

It is known to provide an electrical heating assembly in which a temperature-responsive device is arranged to monitor temperature of a cooking plate, such as of glass-ceramic material, and to provide an electrical output as a function of the temperature of the cooking plate and hence of the temperature of a cooking utensil positioned on an upper surface of the cooking plate. It is known to provide a control system which receives the electrical output from the temperature-responsive device and cooperates in closed-loop manner with the heating element or elements in the heater and a power supply, to control energising of the heating element or elements whereby a predetermined temperature of the cooking plate, and hence of the cooking utensil, is provided and maintained.

Requirements exist for a control system which provides for operation of such an electrical heating assembly in a plurality of operating modes, such as normal, simmer and frying modes, at pre-selected temperatures within such modes.

Requirements also exist for a control system which will additionally allow operation of such an electrical heating assembly in what is known as an open-loop manner, such that the heater is energised at selected pre-set power levels by duty cycle control means.

Control systems of the prior art are relatively complex, requiring a user to operate a number of different manual control devices according to whether closed-loop or open-loop operation is required.

OBJECT OF THE INVENTION

It is an object of the present invention to overcome or minimise this problem.

SUMMARY OF THE INVENTION

According to one aspect of the present invention there is provided an electrical heating assembly comprising an electric heater, a first temperature-responsive device adapted to de-energise the electric heater at a predetermined temperature, a second temperature-responsive device adapted to provide an electrical output as a function of cooking temperature, and a control system, the control system comprising:

- cooking mode selection means having a plurality of settings whereby a predetermined cooking mode is user-selectable for the electrical heating assembly; and
- cooking value selection means adapted for user-selection of cooking temperature within a predetermined temperature range,
- the control system being adapted whereby operation of the cooking mode selection means from one setting to at least one other setting results in a change in the predetermined cooking temperature range provided by the cooking value selection means,
- whereby in a first setting of the cooking mode selection means only the first of the first and second temperature responsive devices is effective to control operation of the heater and in at least a second setting of the cooking mode selection means both the first and second temperature-responsive devices are effective to control operation of the heater.

The cooking temperature may be selected from the temperature of a cooking plate and the temperature of a cooking utensil positioned on a cooking plate.

Display means may be provided to display the selected cooking mode and/or a selected setting of the cooking value selection means and/or the correspondingly-selected cooking temperature and/or the correspondingly-selected heating power. Such display means may comprise at least one opto-electronic display device, such as at least one multi-segment display device, particularly at least one seven-segment display device.

The cooking mode selection means may comprise a multiple-setting switch means, such as a rotary switch, slide switch, touch switch, membrane switch or toggle/push switch.

The cooking value selection means may comprise switch means, of multiple-step or continuously-variable form, for selection of the cooking temperature, and optionally a predetermined heating power, within a range predetermined by the cooking mode selection means. Such switch means may comprise a touch switch, a rotary switch or a slide switch.

Selectable cooking modes may comprise normal, simmer and frying modes.

In the simmer mode, the cooking value selection means may be operated to select predetermined cooking temperatures of from about 60 to about 100 degrees Celsius.

In the frying mode, the cooking value selection means may be operated to select predetermined cooking temperatures of from about 140 to about 300 degrees Celsius.

In the normal mode, the cooking value selection means may be operated to select predetermined cooking temperatures of from about 60 to about 600 degrees Celsius.

Alternatively, in the normal mode, the cooking value selection means may be operated to select predetermined duty cycle power levels of the heater between about 5 percent and about 100 percent of maximum.

The control system may comprise microprocessor-based circuit means.

The first and/or the second temperature-responsive device may comprise an electrical resistance element, such as a platinum resistance element, whose electrical resistance changes as a function of temperature.

The assembly may include a cooking plate having an upper surface for receiving a cooking utensil, and a lower surface, the electric heater being supported in contact with the lower surface of the cooking plate.

The second temperature-responsive device may be provided inside the electric heater substantially in contact with the lower surface of the cooking plate.

The cooking plate may comprise glass-ceramic material.

The control system may be adapted whereby in a first setting of the cooking mode selection means the cooking value selection means operates to provide user-selection of heating power of the electric heater within a predetermined range of heating powers. Such user-selection of heating power may comprise selection of predetermined duty cycles of operation of the electric heater within a predetermined range of duty cycles. Such duty cycles of operation may be provided by electro-mechanical or electronic control means.

The control system may be adapted whereby in the second setting of the cooking mode selection means the second temperature-responsive device and the electric heater are adapted to cooperate in closed-loop manner whereby a predetermined cooking temperature is provided.

By means of the present invention, simple operation of the electrical heating assembly by the control system is provided based on the use of only two selection means to provided cooking mode selection and also cooking temperature or heating power selection.

For a better understanding of the present invention and to show more clearly how it may be carried into effect, reference will now be made, by way of example, to the accompanying drawings in which:

BRIEF DESCRIPTION OF THE INVENTION

FIG. 1 is a schematic representation of an electrical heating assembly provided with an embodiment of a control system according to the present invention;

FIG. 2 is a table showing examples of cooking plate temperatures selected in various operating positions of cooking value selection means according to cooking modes selected by cooking mode selection means in the heating assembly and control system of FIG. 1; and FIG. 3 is a table showing examples of cooking plate temperatures selected in various operating positions of cooking value selection means according to simmer and frying modes selected by cooking mode selection means, and also showing power levels of the heater in the various operating positions of the cooking value selection means in a normal cooking mode selected by the cooking mode selection means.

DESCRIPTION OF PREFERRED EMBODIMENT

Referring to FIG. 1, an electrical heating assembly 2 comprises a glass-ceramic cooking plate 4 of well-known form, having an upper surface 6 for receiving a cooking utensil 8, such as a pan. A lower surface 10 of the cooking plate 4 has an electric heater 12 supported in contact therewith. The electric heater 12 comprises a dish-like support 14, such as of metal, in which is provided a base layer 16 of thermal and electrical insulation material, such as microporous thermal and electrical insulation material. A peripheral wall 18 of thermal insulation material is arranged to contact the lower surface 10 of the cooking plate 4.

At least one radiant electrical resistance heating element 20 is supported relative to the base layer 16. The heating element or elements 20 can comprise any of the well-known forms of heating element, such as wire, ribbon, foil or lamp forms, or combinations thereof. In particular, the heating element or elements 20 can be of corrugated ribbon form, supported edgewise on the base layer 16 of insulation material.

It is to be understood, however, that the present invention is not limited to a heater incorporating at least one radiant electrical resistance element 20. Instead of the radiant electrical resistance element or elements, at least one electrical induction heating element could be provided.

The heating element or elements 20 is or are connected to a power supply 22 by way of leads 24 and a control system 26, which suitably includes a microprocessor-based control arrangement 28.

The cooking utensil 8 is heated by the heating element or elements 20 and its temperature is monitored by a temperature-responsive device 30, which is located substantially in contact with the lower surface 10 of the cooking plate 4 and provides an electrical output as a function of temperature of the cooking plate 4 and hence of the cooking utensil 8.

A further temperature-responsive device 42 is provided in the electric heater 12, which is connected by leads 44 to the control system 26 and is adapted to de-energise the electric heater 12 at a predetermined temperature, to prevent thermal damage to the cooking plate 4 and/or the electric heater 12. Such further temperature-responsive device 40 as illustrated is of electronic probe form, but may alternatively be of electromechanical form.

The temperature-responsive device 30 suitably comprises an electrical resistance element, such as a platinum resistance element, whose electrical resistance changes as a function of temperature, and is electrically connected by leads 32 to the control system 26.

The control system 26 is arranged to receive the temperature-dependant electrical output from the temperature-responsive device 30 and to cooperate in closed-loop manner with the heating element or elements 20 and the power supply 22, whereby predetermined temperatures of the cooking plate 4, and hence of the cooking utensil 8, can be provided and maintained. The control system 26 is also arranged to receive a temperature-dependent electrical output from the temperature-responsive device 42.

The control system 26 is provided with a cooking mode selection means 34 having a plurality of settings, whereby a predetermined cooking mode is user-selectable for the electrical heating assembly 2. Such a cooking mode may, for example, be selected from normal, simmer and frying modes. The cooking mode selection means 34 suitably comprises a multiple-setting switch means, such as a rotary switch, a slide switch, a touch switch, a membrane switch or a toggle/push switch.

The control system 26 is also provided with a cooking value selection means 36, which is adapted for user-selection of at least temperature of the cooking plate 4 within a predetermined temperature range. The cooking value selection means 36 operates in association with the cooking mode selection means 34, whereby operation of the cooking mode selection means 34 from one mode setting to at least one other mode setting results in a change in the predetermined temperature range provided by the cooking value selection means 36.

The cooking value selection means 36 suitably comprises switch means, of multiple-step or continuously-variable form and may suitably comprise a touch switch, a rotary switch or a slide switch.

As illustrated by FIG. 2, the cooking value selection means 36 may be operated to enable selected temperatures of the cooking plate 4 to be provided, within a range of temperature values predetermined in accordance with the setting selected for the cooking mode selection means 34. However, the user need not be concerned about absolute temperature values, but only the position of setting of the cooking value selection means 36. The temperatures provided within each range of temperature values predetermined by the setting selected for the cooking mode selection means 34 may be pre-set according to the position of setting of the cooking value selection means 36. In the example of FIG. 2 the cooking value selection means 36 is provided with nine positions of setting, each one being associated with a pre-set temperature of the cooking plate 4, within a range of temperatures predetermined by the setting selected for the cooking mode selection means 34. With a normal mode of operation selected by the cooking mode selection means 34, the nine positions of setting of the cooking value selection means 36 cover a range of temperature values from 60 to 600 degrees Celsius determined by the temperature-responsive device 42 and not by the temperature-responsive device 30. With a simmer mode of operation selected by the cooking mode selection means 34, the nine positions of setting of the cooking value selection means 36 cover a range of temperature values from 60 to 100 degrees Celsius determined by the temperature-responsive device 30. With a frying mode of operation selected by the cooking mode selection means 34, the nine positions of setting of the cooking value selection means 36 cover a range of temperature values from 140 to 300 degrees Celsius determined by the temperature-responsive device 30. In both the simmer and frying modes the temperature-responsive device operates to prevent thermal damage to the cooking plate 4 and/or the electric heater 12.

As illustrated by FIG. 3, the control system 26 is also suitably adapted whereby, in the normal setting of the cooking mode selection means 34, the cooking value selection means 36 operates to provide user-selection of heating power of the electric heater 12 within a predetermined range of heating powers without use of the temperature-responsive device 30. Such user-selection of heating power suitably comprises selection of predetermined duty cycles of operation of the electric heater 12 within a predetermined range of duty cycles, such as from 5 percent to 100 percent of maximum, while the temperature-responsive device 42 prevents thermal damage to the cooking plate 4 and/or the electric heater 12. Such duty cycles of operation may be provided by electro-mechanical or electronic control means 38, which may comprise an energy regulator or means to provide burst-fire control or pulsing or phase-control of the power supply 22. Here, as in FIG. 2, the temperature-responsive device 30 is employed when simmer and frying modes of operation are selected by the cooking mode selection means 34, such that, in the simmer mode, the nine positions of setting of the cooking value selection means 36 cover a range of temperature values from 60 to 100 degrees Celsius and such that, in the frying mode, the nine positions of setting of the cooking value selection means 36 cover a range of temperature values from 140 to 300 degrees Celsius.

Display means 40 is suitably provided to display the cooking mode selected by the cooking mode selection means 34 and/or the selected settings of the cooking value selection means 36 and/or the correspondingly-selected cooking plate temperatures and/or the correspondingly-selected heating powers. Such display means 40 may comprise at least one opto-electronic display device, such as at least one multi-segment display device, for example at least one seven-segment display device.

We claim:

1. An electrical heating assembly comprising an electric heater, a first temperature-responsive device adapted to de-energize the electric heater at a predetermined temperature, a second temperature-responsive device adapted to provide an electrical output as a function of cooking temperature, and a control system the control system comprising:

cooking mode selection means having a plurality of settings whereby a predetermined cooking mode is user-selectable for the electrical heating assembly, whereby in at least one first setting of the cooking mode selection means only the first of the first and second temperature-responsive devices is effective to control operation of the heater and in at least one second setting of the cooking mode selection means both the first and second temperature-responsive devices are effective to control operation of the heater; and cooking value selection means adapted for user selection of cooking temperature within a predetermined temperature range, the control system being adapted whereby operation of the cooking mode selection means from at least one first setting to at least one second setting results in a change in the predetermined cooking temperature range provided by the cooking value selection means, whereby the predetermined cooking temperature range in the at least one second setting is narrower than and lies within the predetermined cooking temperature range in the at least one first setting.

2. assembly as claimed in claim 1, wherein the cooking temperature is selected from the temperature of a cooking plate and the temperature of a cooking utensil positioned on a cooking plate.

3. An assembly as claimed in claim 1, wherein display means is provided to display at least one of the selected cooking mode, a selected setting of the cooking value selection means, the correspondingly-selected cooking temperature, and the correspondingly-selected heating power.

4. An assembly as claimed in claim 3, wherein the display means comprises at least one opto-electronic display device.

5. An assembly as claimed in claim 4, wherein the at least one optoelectronic display device comprises at least one multi-segment display device.

6. An assembly as claimed in claim 1, wherein the cooking mode selection means comprises a multiple-setting switch means.

7. An assembly as claimed in claim 6, wherein the multiple-setting switch means is selected from a rotary switch, slide switch, touch switch, membrane switch and toggle/push switch.

8. An assembly as claimed in claim 1, wherein the cooking value selection means comprises switch means for selection of the cooking temperature within a range predetermined by the cooking mode selection means.

9. An assembly as claimed in claim 8, wherein the switch means comprises means selected from a touch switch, a rotary switch and a slide switch.

10. An assembly as claimed in claim 1, wherein selectable cooking modes comprise normal, simmer and frying modes.

11. An assembly as claimed in claim 10, wherein, in the simmer mode, the cooking value selection means is operated to select predetermined cooking temperatures of from about 60 to about 100 degrees Celsius.

12. An assembly as claimed in claim 10, wherein, in the frying mode, the cooking value selection means is operated to select predetermined cooking temperatures of from about 140 to about 300 degrees Celsius.

13. An assembly as claimed in claim 10, wherein, in the normal mode, the cooking value selection means is operated to select predetermined cooking temperatures of from about 60 to about 600 degrees Celsius.

14. An assembly as claimed in claim 10, wherein, in the normal mode, the cooking value selection means is operated to select predetermined duty cycle power levels of the heater between about 5 percent and about 100 percent of maximum.

15. An assembly as claimed in claim 1, wherein at least one of the first and the second temperature-responsive device comprises an electrical resistance element whose electrical resistance changes as a function of temperature.

16. An assembly as claimed in claim 1 and including a cooking plate having an upper surface for receiving a cooking utensil, and a lower surface, the electric heater being supported in contact with the lower surface of the cooking plate.

17. An assembly as claimed in claim 16, wherein the second temperature-responsive device is provided inside the electric heater substantially in contact with the lower surface of the cooking plate.

18. An assembly as claimed in claim 1, wherein the control system is adapted whereby in the first setting of the cooking mode selection means the cooking value selection means operates to provide user-selection of heating power of the electric heater within a predetermined range of heating powers.

19. An assembly as claimed in claim 18, wherein the user-selection of heating power comprises selection of predetermined duty cycles of operation of the electric heater within a predetermined range of duty cycles.

20. An assembly as claimed in claim 19, wherein the duty cycles of operation are provided by means selected from electro-mechanical and electronic control means.

21. An assembly as claimed in claim 1, wherein the control system is adapted whereby in the second setting of the cooking mode selection means the second temperature-responsive device and the electric heater are adapted to co-operate in a closed loop manner whereby a predetermined cooking temperature is provided.

22. An assembly as claimed in claim 11, wherein, in the frying mode, the cooking value selection means is operated to select predetermined cooking temperature of from about 140 to about 300 degrees Celsius.

23. An assembly as claimed in claim 1, wherein two second settings are provided, the predetermined cooking temperature range in each of the second settings being narrower than the predetermined cooking temperature range in the at least one first setting and not overlapping the range of the other of the second settings.

24. An electrical heating assembly comprising an electric heater, a first temperature-responsive device adapted to de-energise the electric heater at a predetermined temperature, a second temperature-responsive device adapted to provide an electrical output as a function of cooking temperature, and a control system, the control system comprising:

cooking mode selection means having a plurality of settings whereby a predetermined cooking mode is user-selectable for the electrical heating assembly, whereby in at least one first setting of the cooking mode selection means only the first of the first and second temperature-responsive devices is effective to control operation of the heater and in at least one second setting of the cooking mode selection means both the first and second temperature-responsive devices are effective to control operation of the heater; and cooking value selection means adapted for user selection of cooking temperature within a predetermined temperature range, the control system being adapted whereby operation of the cooking mode selection means from at least one first setting to at least one second setting results in a change in the predetermined cooking temperature range provided by the cooking value selection means, wherein two second settings are provided, the predetermined cooking temperature range in each of the second settings being narrower than the predetermined cooking temperature range in the at least one first setting and not overlapping the range of the other of the second settings.

25. An assembly as claimed in claim 24, wherein in one of the second settings the cooking value selection means is operated to select predetermined cooking temperatures of from about 60 to about 100 degrees Celsius and in the other of the second settings the cooking value selection means is operated to select predetermined cooking temperatures of from about 140 to about 300 degrees Celsius.

* * * * *